US005669658A

United States Patent [19]

Liles

[11] Patent Number: 5,669,658

[45] Date of Patent: Sep. 23, 1997

[54] CONVERTIBLE TABLE AND SUPPORT

[76] Inventor: Raymond D. Liles, 373 Woodland Park Rd., Stonewall, La. 71078

[21] Appl. No.: 680,828

[22] Filed: Jul. 16, 1996

[51] Int. Cl.[6] ..... A47B 85/04

[52] U.S. Cl. ..... 297/123; 297/122; 297/110; 297/158.3; 297/172; 108/11

[58] Field of Search ..... 297/122, 123, 297/124, 140, 110, 108, 158.3, 157.1, 171, 172; 108/11, 12, 13, 62

[56] References Cited

U.S. PATENT DOCUMENTS

| | | | |
|---|---|---|---|
| 1,164,243 | 12/1915 | Wasserman | 297/110 |
| 1,279,606 | 9/1918 | Strid | 297/110 |
| 3,672,719 | 6/1972 | Haukedahl | 297/158.3 |
| 4,040,693 | 8/1977 | Peterson et al. | 297/123 |
| 4,382,627 | 5/1983 | Dean | 297/124 |
| 4,647,107 | 3/1987 | Hoover et al. | 297/124 |

*Primary Examiner*—Peter M. Cuomo
*Assistant Examiner*—Anthony D. Barfield
*Attorney, Agent, or Firm*—John M. Harrison

[57] ABSTRACT

A convertible table and support characterized by a support which is pivotally mounted on a support frame and may be reversibly pivoted from an upright sitting position resting on the support frame to an inverted position adjacent to the support frame to define a bench and table combination. The support is characterized by a seat which rests on the support frame when the support is in the upright sitting position with a backrest extending upwardly from the rear edge of the seat. A pivoting arm extends from each side of the seat adjacent to the front edge thereof and is pivotally mounted between respective support frame arms extending upwardly from the support frame. When the support is in the inverted or table position, the horizontally-oriented seat is supported by the support frame and the backrest and functions as a table top, while the support frame defines a bench. In a preferred embodiment an armrest is provided on each side of the support between the backrest and seat.

5 Claims, 2 Drawing Sheets

1
12
12a
11
17
14a
15
17
14
4
2
3a
15
8
5
7
6
3b
4
3a
3

16b
16
16a 12
11
1
12
12a
14, 14a
17
11
17
15
16
14, 14a
4
2
7
8
5
6
6
4
3
3a
3a

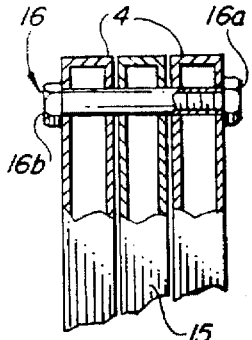
FIG. 5
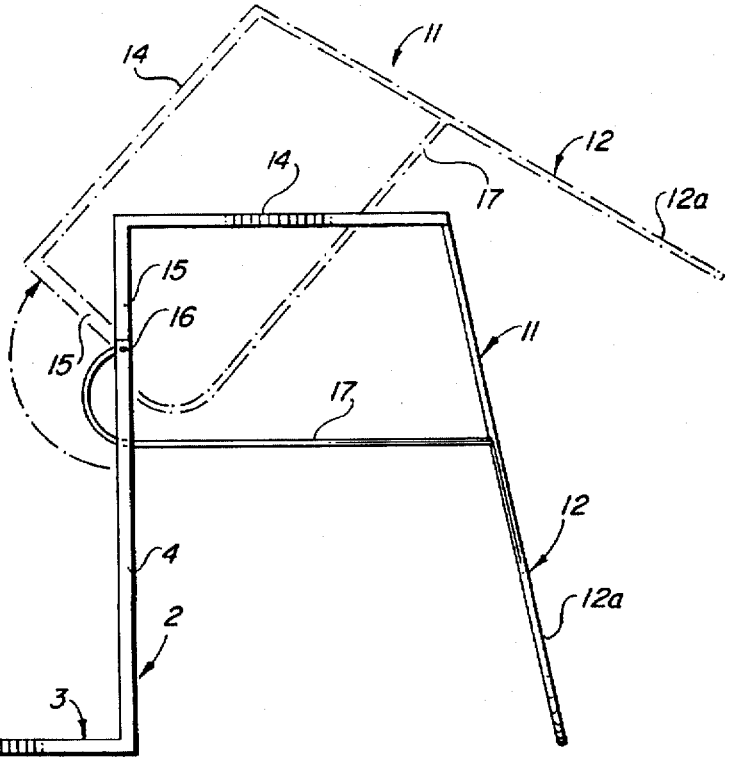
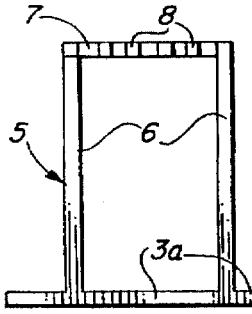
FIG. 3B
FIG. 2
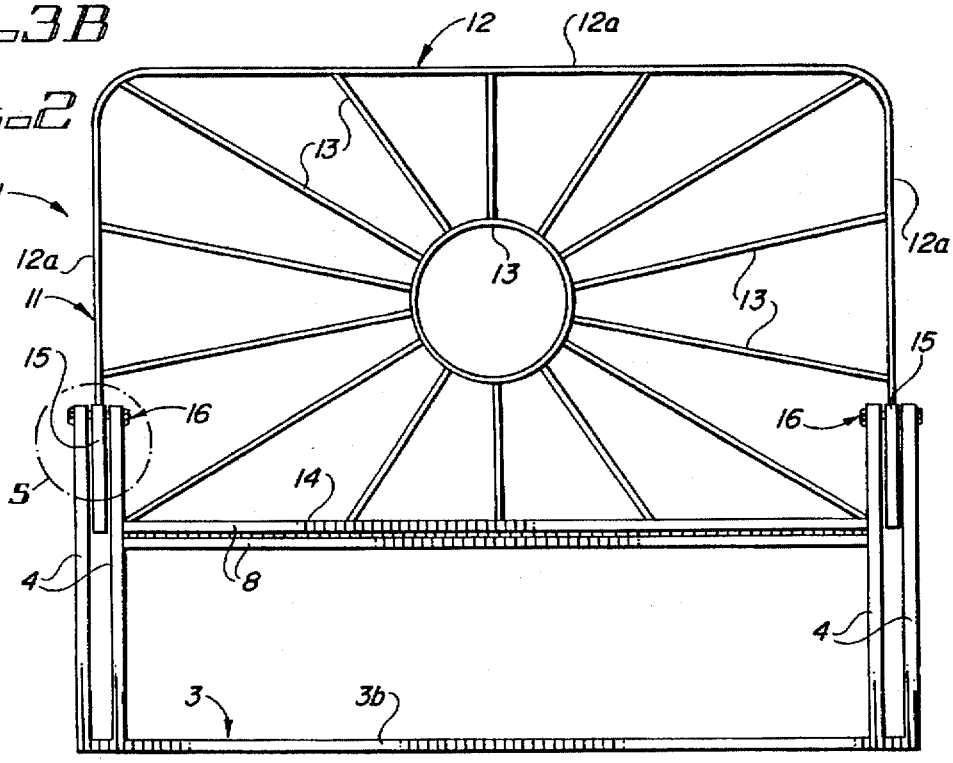

CONVERTIBLE TABLE AND SUPPORT

BACKGROUND OF THE INVENTION

FIELD OF THE INVENTION

This invention relates to patio or picnic furniture such as picnic tables and chairs and more particularly, to a convertible table and support characterized by a support frame having a bench and a support which is pivotally mounted on the support frame. The support may be reversibly pivoted from an upright, back-supported seating position resting on the support frame bench to an inverted position adjacent to the support frame, to define a picnic bench and table. In a preferred embodiment the support is characterized by a seat having an arm rest and a pivoting arm extending from each side of the seat adjacent to the front edge thereof and a backrest angling from the rear edge of the seat. Each pivoting arm is interposed between a pair of support frame arms extending upwardly from each side of the front edge of the support frame and a pivot pin is extended through aligned openings in the support frame arms and pivoting arms. When the support is in the inverted, table configuration, the horizontally-oriented seat is supported on the support frame arms and the inverted backrest to define a table top, and the user may be seated on the picnic bench in the support frame. In a preferred embodiment an armrest is provided on each side of the support, between the seat and backrest.

One of the problems encountered in using patio or picnic furniture, including chairs and picnic tables, is that of finding adequate space for the furniture and construction that requires stepping over frame or bench members. Since patio tables, benches and chairs are typically separate structures, they have a tendency to clutter the patio area and hinder optimum use of patio space. The convertible table and support of this invention solves the problem of adequate space for picnic tables and benches by combining a picnic table, picnic bench and sitting support into a single construction. When the picnic table and picnic bench in the convertible table and support are not in use and conversion to the sitting support configuration is desired, the support is simply pivoted to rest upon the bench and thus define the sitting support, saving considerable space.

Accordingly, an object of this invention is to provide a convertible table and support characterized by a combined picnic table, bench and sitting support which allows access from the side without having to step over elevated frame or bench members.

Another object of this invention is to provide a convertible table and support characterized by a sitting support with backrest which may be pivoted from an upright, back-supported sitting configuration to an inverted table configuration to define a bench and picnic table combination.

Still another object of this invention is to provide a convertible table and support characterized by a support frame and bench having a support which is pivotally mounted on the support frame and includes a seat and a backrest extending upwardly from the rear edge of the seat, wherein the front of the seat is pivotally mounted to the support frame and may be reversibly pivoted from an upright position resting on the bench in sitting configuration to an inverted position with the seat horizontally oriented, to define a picnic table and bench.

SUMMARY OF THE INVENTION

These and other objects of the invention are provided in a one-piece convertible table and support characterized by a support frame and bench having a support pivotally mounted thereon. The support normally rests on the bench in the support frame, with a backrest extending in an upright configuration from a seat to define a sitting platform. The support may be optionally pivoted to an inverted configuration adjacent to the support frame, to define a picnic table, leaving the bench available for seating. In a preferred embodiment the support frame mounts the bench and a pair of spaced-apart, parallel support frame arms extend upwardly from the front edge of the support frame on each side thereof. A corresponding pivoting arm extends from each side of the front of the support and is interposed between the respective support frame arms, respectively, and a pivot pin or bolt extends through aligned openings provided in each support frame arm and cooperating pivoting arm. Accordingly, the support seat rests on the bench when the convertible table and support is in the upright, back-supported, seating configuration and after being pivoted to the table configuration, the support is stabilized on the support frame arms and backrest with the seat horizontally disposed and the picnic bench is exposed in the support frame. In a preferred embodiment an armrest is provided on each side of the support between the backrest and each pivoting arm.

BRIEF DESCRIPTION OF THE DRAWINGS

The invention will be better understood by reference to the accompanying drawings, wherein:

FIG. 2 is a front view of the convertible table and support illustrated in FIG. 1;

FIG. 3B is a right side view of the convertible table and support with the support illustrated in the inverted, table configuration, also illustrating in phantom the support partially pivoted into the upright, back-supporting seating configuration;

FIG. 5 is an enlarged sectional view taken at the section circle 5 in FIG. 2, of the pivoting articulation of the support with respect to the support frame element of the convertible table and support of this invention.

DESCRIPTION OF THE PREFERRED EMBODIMENTS

Figure 1:
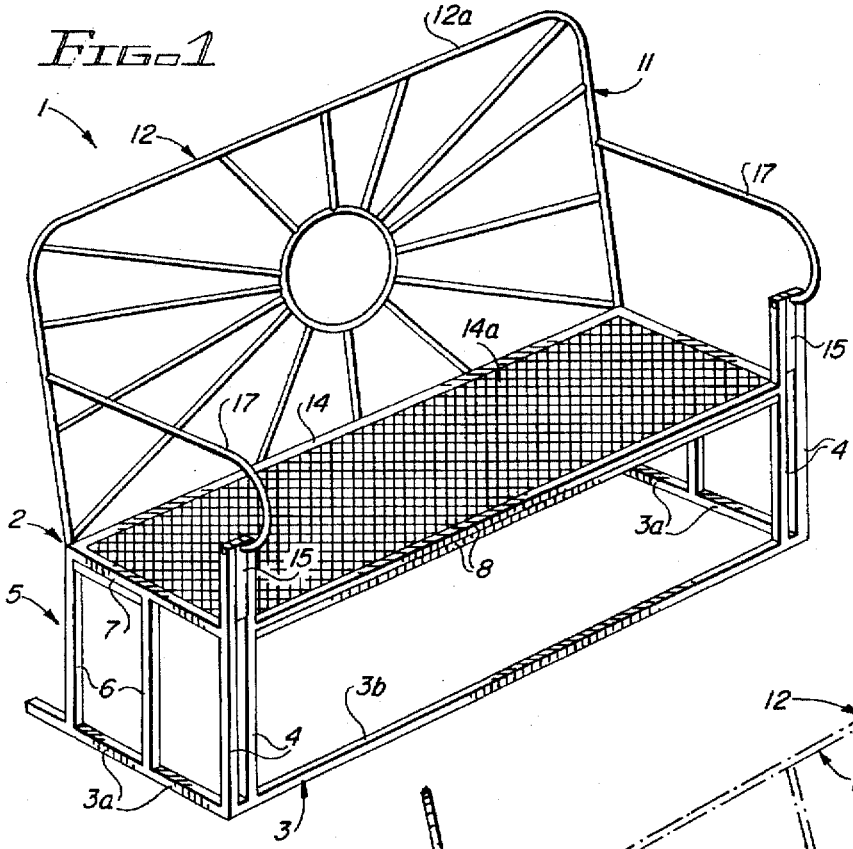
FIG. 1 is a perspective view of a preferred embodiment of the convertible table and support of this invention, illustrated in the upright, back-supporting seating configuration.

Referring initially to FIGS. 1–3B of the drawings, in a preferred embodiment the convertible table and support of this invention is generally illustrated in back-supporting, sitting configuration by reference numeral 1. The convertible table and support 1 is characterized by a support frame 2, typically constructed of plastic, aluminum, iron or steel square tubing and including a support frame base 3, having a pair of spaced side base members **3*a* (illustrated in FIGS. 1, 3A and 3B), spanned by a front base member 3*b* (illustrated in FIGS. 1 and 2). As illustrated in FIG. 2, a pair of support frame arms 4 extend upwardly from each end of the front base member 3*b*, in closely-spaced, parallel relationship with respect to each other. As further illustrated in FIGS. 1, 3A and 3B, a bench 5** includes spaced bench legs 6, extending upwardly from fixed attachment to each side base member 3*a* behind the support frame arms 4 and spanned at the top ends thereof by bench connecting bars 7. Multiple support members 8 span the bench support connecting bars 7 of the bench supports 5, in spaced relationship with respect to each other.

Figure 4:
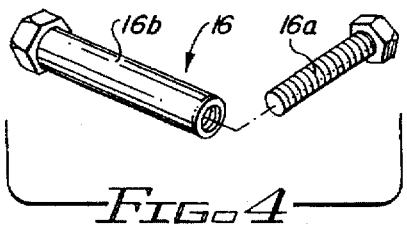
FIG. 4 is an exploded, perspective view of a preferred pivot bolt element of the convertible table and support.

Referring next to FIGS. 2–5 of the drawings, a support 11 is pivotally mounted on the support frame 2, as hereinafter further described and includes a generally rectangular seat 14, typically provided with expanded metal 14*a* as a supporting surface and having a backrest 12, characterized by a generally rectangular backrest frame 12*a*, which angles upwardly from the rear edge of the seat 14. As illustrated in FIGS. 1 and 2, a backrest grill 13 of selected design, typically constructed from plastic members as well as metal round rod or bar stock, extends within the backrest frame 12*a* in a selected pattern. Alternatively, a solid backrest panel or alternative backrest grill 13 configuration (not illustrated) may be provided in the backrest frame 12*a*, as desired. A pivoting arm 15 extends from each side of the seat 14 at the front edge thereof and each pivoting arm 15 is interposed between, and aligned with the corresponding pair of support frame arms 4 when the convertible table and support 1 is in the back-supporting seating configuration illustrated in FIGS. 1 and 2. As illustrated in FIGS. 2, 4 and 5, a pivot bolt 16 extends through aligned openings (not illustrated) provided in the parallel support frame arms 4 and pivoting arm 15. As further illustrated in FIG. 4, each pivot bolt 16 is typically characterized by an exteriorly-threaded, male bolt member 16*a* and an interiorly-threaded, companion female bolt member 16*b* which threadably receives the threaded end of the male pin member 16*a*. As further illustrated in FIG. 1, in a preferred embodiment of the invention an armrest 17 extends between the backrest frame 12*a* and pivoting arm 15, on each side of the support 11.

Figure 3A:
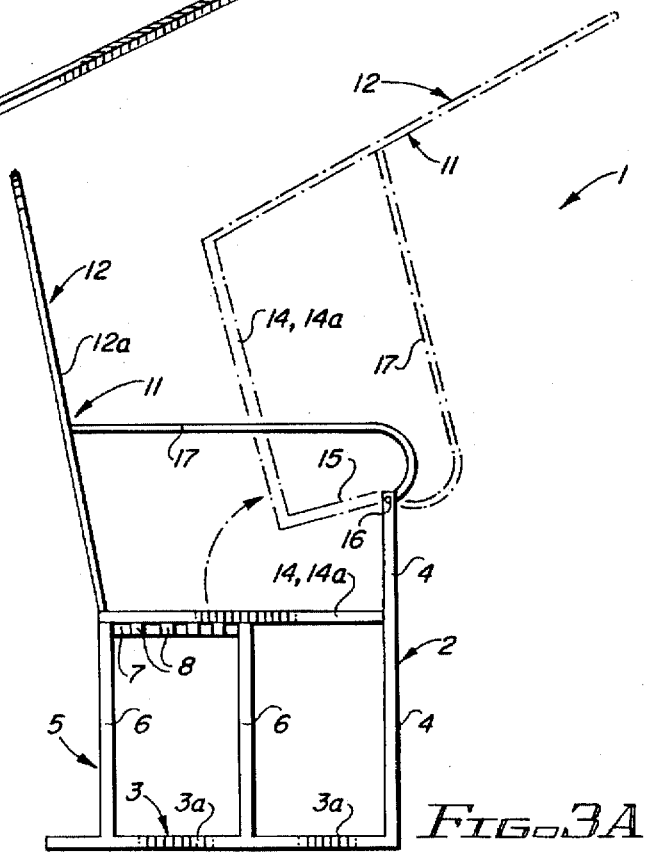
FIG. 3A is a right side view of the convertible table and support illustrated in FIG. 1, with the support partially pivoted to the inverted, table configuration, as illustrated in phantom.

Referring again to FIGS. 1–3B of the drawings, the support 11 functions as a back-supported sitting member when resting in the upright configuration on the support frame 2 and bench 5, as illustrated in FIGS. 1 and 3A. The support 11 may be lifted from the bench 5 and pivoted on the pivot pins 16, as illustrated in phantom in FIGS. 3A and 3B, to an inverted configuration, until the backrest 12 rests on the supporting surface, spaced from the support frame arms 4 of the support frame 2. The seat 14 is then supported in a horizontal orientation by the backrest 12 and the pivoting arms 15 and support frame arms 4, as illustrated in FIG. 3B. When the support 11 is in this inverted configuration, the bench 5 may function as a picnic bench and the inverted support 11 as a picnic table, such that one may enter the space between the bench 5 and the support frame 2 from the side without having to step over elevated supports or frame members. Likewise, as illustrated in phantom in FIG. 3B, the support 11 may be quickly and easily pivoted from the inverted configuration back to the upright, sitting configuration illustrated in FIGS. 1–3A, as desired.

In a most preferred embodiment of the invention the respective elements of the support frame 2 and support 11, including the bench 5, are constructed of square steel tubing of selected size, depending upon the specific application of the convertible table and support 1. Furthermore, the backrest 12 is preferably constructed of round bar stock and the various elements of the support frame 2 and support 11 are typically welded together in conventional fashion. Moreover, the design of both the backrest grill 13 and the expanded metal 14*a* in the seat 14 may be altered, as desired.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A convertible table and support comprising a support frame base having opposite base ends; a bench mounted on said support frame base; a pair of support frame arms extending upwardly from said base ends, respectively, of said support frame base; a pivoting support seat having seat ends, normally disposed on said bench; a backrest extending from said support seat; a pivoting arm extending from each of said seat ends of said support seat to said support frame arms, respectively; and a pivot pin extending through said support frame arms and said pivoting arm, respectively, whereby said support seat and said backrest are selectively pivoted from a first position wherein said support seat rests on said bench, to a second inverted position wherein said support seat is substantially horizontally disposed on said support frame arms and said backrest.

2. The convertible table and support of claim 1 wherein said backrest further comprises a backrest frame and a grill arranged in a selected pattern in said backrest frame.

3. The convertible table and support of claim 1 wherein said support seat further comprises a seat of selected design provided on said seat frame.

4. The convertible table and support of claim 1 wherein:

(a) said backrest further comprises a backrest frame and a grill arranged in a selected pattern in said backrest frame; and (b) said support seat further comprises a seat frame and a seat of selected design provided on said seat frame.

5. The convertible table and support of claim 4 comprising an arm rest extending between said pivoting arm and said backrest frame.

* * * * *